US007234335B2

(12) United States Patent
Lolli

(10) Patent No.: US 7,234,335 B2
(45) Date of Patent: Jun. 26, 2007

(54) METHOD FOR PRODUCING A HEAD ELEMENT FOR HEATERS

(76) Inventor: Walter Lolli, Via Baracca 5, Casalecchio di Reno, Bologna (IT) 40033

( * ) Notice: Subject to any disclaimer, the term of this patent is extended or adjusted under 35 U.S.C. 154(b) by 0 days.

(21) Appl. No.: 10/476,926

(22) PCT Filed: Jun. 12, 2002

(86) PCT No.: PCT/IB02/02162

§ 371 (c)(1),
(2), (4) Date: Nov. 5, 2003

(87) PCT Pub. No.: WO02/101311

PCT Pub. Date: Dec. 19, 2002

(65) Prior Publication Data

US 2004/0144833 A1 Jul. 29, 2004

(30) Foreign Application Priority Data

Jun. 13, 2001 (IT) ..... BO2001A0375

(51) Int. Cl.
*B21D 22/20* (2006.01)
*B23P 15/26* (2006.01)
*F28F 9/02* (2006.01)

(52) U.S. Cl. ..... 72/348; 29/890.052; 165/153; 165/175

(58) Field of Classification Search ..... 165/153, 165/173, 175; 29/890.052; 72/348
See application file for complete search history.

(56) References Cited

U.S. PATENT DOCUMENTS 1,731,575 A * 10/1929 Hyde ..... 165/175
2,262,627 A * 11/1941 Whitesell, Jr. et al. . 29/890.052
2,713,195 A * 7/1955 Hemmer ..... 29/890.052
2,930,590 A * 3/1960 Sartori et al. ..... 165/175
3,516,483 A * 6/1970 Benteler et al. ..... 165/175
3,741,849 A * 6/1973 Hardy ..... 165/173
4,846,268 A * 7/1989 Beldam et al. ..... 165/153
4,969,512 A * 11/1990 Hisao et al. ..... 165/153
5,946,940 A * 9/1999 Inoue ..... 62/509

(Continued)

FOREIGN PATENT DOCUMENTS

CH 372 448 A 10/1963

(Continued)

*Primary Examiner*—Leonard R. Leo
(74) *Attorney, Agent, or Firm*—William J. Sapone; Coleman Sudol Sapone P.C.

(57) ABSTRACT

According to a method for producing head elements for heaters, a piece of sheet metal (1) is deep drawn and cut along the edge (9) of an open side (6) to obtain a hollow body (8) with larger and narrower sides (4,5,14,15). An aperture (12) is made on each opposite larger side (4,5) of the hollow body, and threaded rings (26) are then applied around the lateral through apertures (12). Notches (16) are made on the opposite large sides (4,5), along the edge (9) of the open side (6), and then three cores (18) are introduced through the edge (9), so that a flange (17) around the notches (16) can be made by pressing, so as to close the sheet metal (1) around the cores (18) widening the notches (16). After the cores (18) have been removed, the edge (9) is welded along the flange (17) of the widened notches (16), thus obtaining holes (21) separated from each other.

11 Claims, 3 Drawing Sheets

U.S. PATENT DOCUMENTS 6,189,606 B1 * 2/2001 Chevallier ..... 165/173
6,315,037 B1 * 11/2001 Haussmann ..... 165/174
6,467,536 B1 * 10/2002 Abate et al. ..... 165/153

FOREIGN PATENT DOCUMENTS

FR 966 689 A 10/1950
FR 1349270 A * 12/1963 ..... 165/175
FR 1375437 A * 9/1964 ..... 165/175
IT 596482 A * 7/1959 ..... 165/175
JP 04100634 A * 4/1992

* cited by examiner

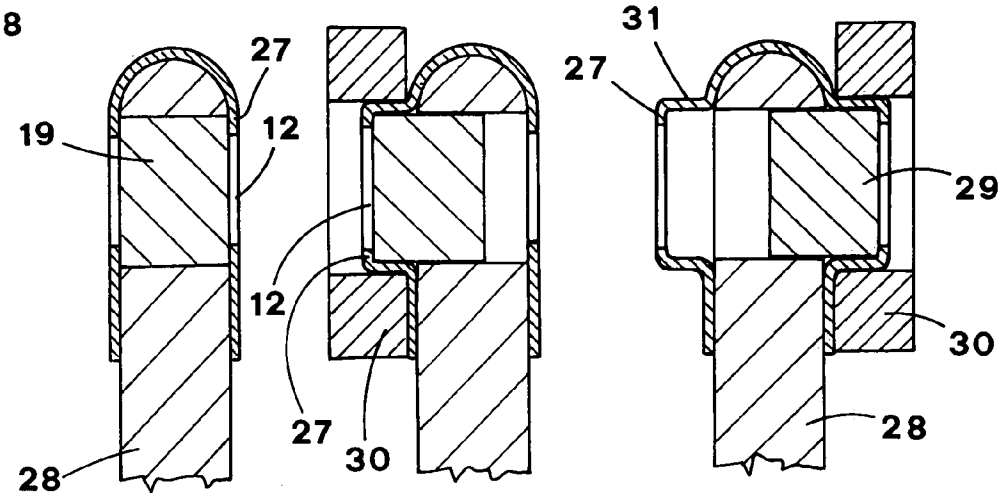
FIG.13
FIG.12
FIG.11
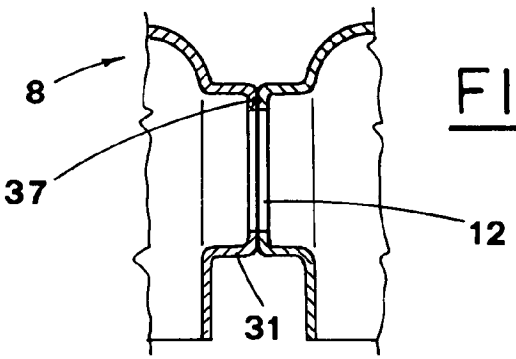
FIG.15
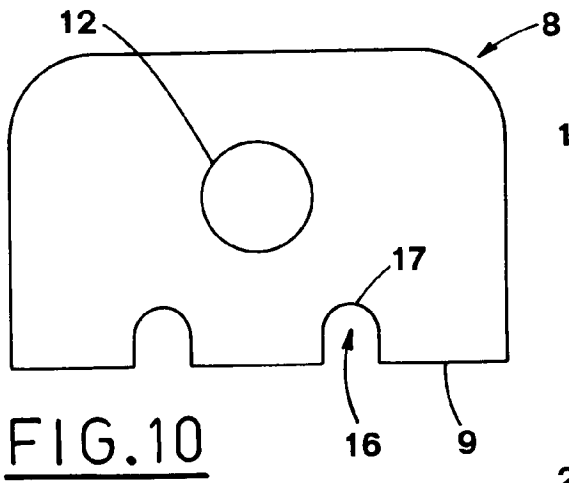
FIG.10
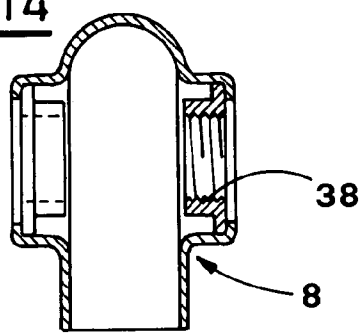
FIG.14

METHOD FOR PRODUCING A HEAD ELEMENT FOR HEATERS

FIELD OF THE INVENTION

The present invention relates to the production of heaters.

In particular, the present invention relates to the production of head elements used for supporting and connecting the tubular heating elements, which form the heater.

DESCRIPTION OF THE PRIOR ART

According to known methods, heaters for e.g. civil and industrial use are produced by joining tubular elements using head elements, which support and join the tubular elements with each other.

The groups, composed of two or more tubular elements joined one to another by head elements, are connected to each other by liquid-tight connection applied between each pair of head elements, thus forming a heater.

There are different methods for producing the head elements.

The Patent Publication FR 1.201.614 describes the preparation of the head element by fusion technique and subsequent working of the so obtained workpiece.

The obtained head element is composed of a hollow body with four parallel holes situated on a narrow and long side of the body and communicating with the inside, and of two opposite apertures made on the two wider surfaces of the body.

The four parallel holes are machined inside while the opposite apertures are threaded internally.

Subsequently, two head elements are applied to the opposite extremities of four tubular elements by introducing and fastening, by welding, the tubular elements ends into the four parallel holes.

Threaded joints are inserted into the opposite and threaded apertures of the head elements so as to connect the thus obtained groups to each other.

According to the document FR 1.425.677, the tubular elements are joined to the head elements by an adhesive.

The drawbacks of the head elements obtained in this way derive from the difficulty in producing, by fusion, a head element which is hollow and features holes of small diameter conducting to the cavity.

This constructive feature imposes the use of cores, which must be crumbled in order to be removed from the piece obtained by fusion, thus increasing the number of working steps and production costs.

Moreover, it is difficult to make the fused material flow appropriately in the dies to avoid a high number of wastes.

This problem imposes also the choice of those materials which feature good flowability when fused, in place of other materials, which would be cheaper, but are more difficult to be treated by fusion.

The publication EP-A-0854347 describes a method for obtaining head elements, which have an aperture on their narrow side, opposite to the side with holes for connection with the tubular elements.

This conformation allows insertion of a suitably shaped core into the die during the fusion, to support easily the core and to remove it without the necessity of subsequent operations for cleaning and finishing of the inner cavity.

However, it is necessary to close the aperture before assembling the tubular elements.

According to another known method, the head elements are obtained by pressing two semi-shells of e.g. sheet metal, and welding the two semi-shells along their whole contour.

In this way, the head element is produced from a cheap material, e.g. a ferrous material, using a procedure that is not particularly complicated, such as fusion.

Nevertheless, the welding of the two semi-shells is very difficult, because of the welding length and critical position, as it extends along the matching line of the two curved surfaces and must pass across further curved sections.

Since the head element must be liquid-tight, so the welding must be performed correctly, thus increasing the difficulty and costs of this working operation.

Moreover, after the welding had been finished, it is necessary to finishing the whole welded area, in order to make it shapely.

This step increases again the production time and costs.

SUMMARY OF THE INVENTION

The object of the present invention is to propose a method for producing a head element composed of one single body, by more pressing steps, without the drawbacks resulting from the fusion procedure and without the necessity to weld other closing elements of the head element.

Another object of the present invention is to propose a method, which allows a reduction of time and costs of the head element production.

A further object of the present invention is to propose a method, which allows using ferrous material, which is cheap and easy to work.

A still further object of the present invention is to propose a head element obtained by the above mentioned method, whose production is cheap and does not require extensive time, and which is shapely, so as to reduce as much as possible other finishing operations.

In particular, the proposed head element is produced in such a way that it does not require grinding of extended surfaces, which have been welded in critical points.

The above-mentioned objects are obtained by a method for producing head elements for heaters, characterized in that it includes:

preparing of a piece of a sheet metal;

deep drawing said sheet metal piece to obtain a hollow molded piece, defined by a base wall, sides joined to and surrounding the base wall and forming an open side;

cutting the sides along the open side, to define a hollow body with an edge, which is uniform and extends around said open side;

making a lateral through aperture on two opposite sides to obtain apertured opposite sides;

providing connection means around each lateral through aperture;

making of at least one notch, on the apertured opposite sides, along said edge;

introducing at least two cores into said edge matching areas without said at least one notch;

stamping a flange extending around each of said at least one notch and included between said cores, so as to close the sheet metal around said cores and in the area of said edge, thus widening said notches;

removing said cores from the hollow body;

welding of said edge along said flange of said widened at least one notch, so as to obtain a series of holes separated from each other.

According to a different embodiment of the method for producing the head elements after the hollow body is obtained the following steps are performed:

making a lateral through aperture on each two opposite sides to obtain two apertured opposite sides;

making at least one notch, on each of said apertured opposite sides, along said edge;

introducing at least two cores into said edge in areas without said at least one notch;

pressing a flange extending around said notches and included between said cores, so as to close the sheet metal around said cores and in the area of said edge, thus widening said notches;

removing said cores from the hollow body;

welding said edge along said flange of said widened at least one notch, so as to obtain holes separated from each other;

providing fastening means on each lateral through aperture on each of said apertured opposite sides.

From the method a head element for heaters is obtained, which is made in a single hollow body, defined by a base wall, sides joined to and surrounding the base wall, at least two holes turned toward the inside of said hollow body, with at least one lateral through aperture made on two opposite sides defining two apertured sides, characterized in that:

said body is obtained from a single part of a deep-drawn metal sheet;

said holes are delimited by a press-shaped edge of an open side, opposite to said base wall of said hollow body, with notches made on said edge and widened by pressing, so as to define pressed flanges, which surround the notches and are welded to each other to separate said holes; and fastening means are provided on each lateral through aperture.

BRIEF DESCRIPTION OF THE DRAWINGS

In accordance with the invention, the head elements and the method of its production are defined by the characteristic features reported in independent claims concerning the product and the method, respectively, and other preferred characteristic features reported in additional claims.

In the following, the invention is described in a more detailed way with reference to particular, but not only embodiments and with reference to the enclosed drawings, in which:

FIG. 10 is a view of constructive variant of the body forming the head element;

Figure 1:
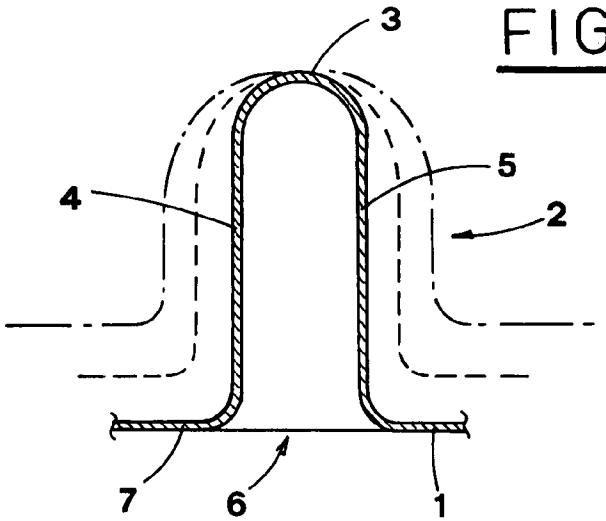
FIG. 1 is a lateral section view of the body of a head element during its forming by pressing, according to the present method.

Figures from 11 to 13 show three working steps necessary to complete the head element according to the above mentioned constructive variant;

FIG. 14 is a view of the finished head element, according to the above mentioned constructive variant;

FIG. 15 is a view of two finished head elements, according to the above-mentioned constructive variant; joined to each other.

BEST MODES OF CARRYING OUT THE INVENTION

According to the present method, with reference to Figures from 1 to 4, head elements for heaters are produced beginning from a piece of sheet metal 1.

The piece of sheet metal 1 is first deep-drawn to obtain a hollow molded piece 2 defined by a base wall 3, two opposite larger sides 4, 5 joined to the base wall 3, two narrower sides 14, 15, joined to the base wall 3 and integral with the two opposite large sides 4, 5, and an open side 6, situated opposite with respect to the base wall 2.

It is assumed that there will be always two larger sides and two narrower sides, as this is the common practice in manufacturing these fittings. It is self evident that the method can be equally applied to a head having equally extending sides, this being also part of the claimed invention.

The deep drawing of the sheet metal 1 to obtain the hollow molded piece 2, is performed according to a series of subsequent steps, e.g. three steps.

The intermediate forms assumed by the hollow molded piece 2 during the drawing step are indicated with dotted line and broken ling in FIG. 1.

According to particular materials and dimensions of the head element to be formed, it is possible to obtain the hollow molded piece by only one drawing step, without leaving the inventive scope of the present invention.

The deep-drawing step can be performed by using a mechanical press or a fluid-pressing device (hydro-forming), or any other suitable apparatus.

Figure 3:
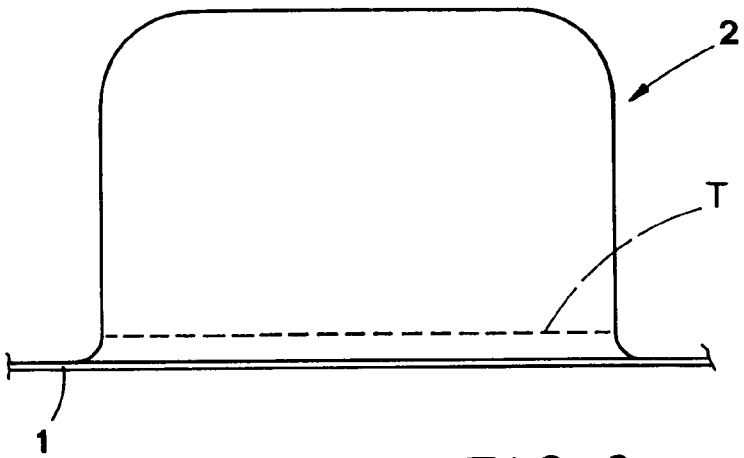
FIG. 3 is a lateral view of the body of FIG. 1.
Figure 2:
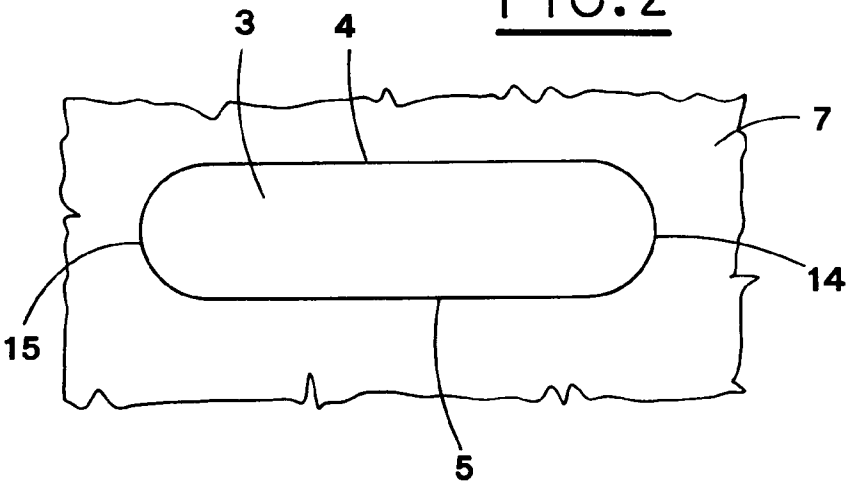
FIG. 2 is a top view of the body of FIG. 1.

The base wall 3 and the narrow sides 14, 15 can be curved, as shown in FIGS. 2 and 3, or they can have more or less rounded corners and edges, so that the head element can show a squared form.

Figure 4:
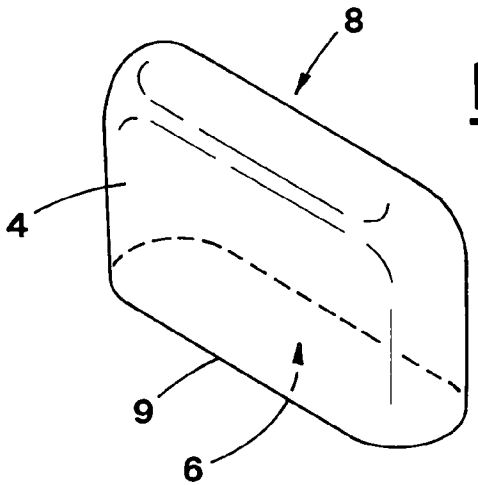
FIG. 4 is a perspective view of the body of FIG. 1.

Later, the opposite large sided 4, 5 and the narrow sides 14, 15 are cut near the open side 6, along the broken line T of FIG. 3, so as to define a hollow body 8 (FIG. 4), with an edge 9 uniform and oblong, extending around the open side 6.

Figure 5:
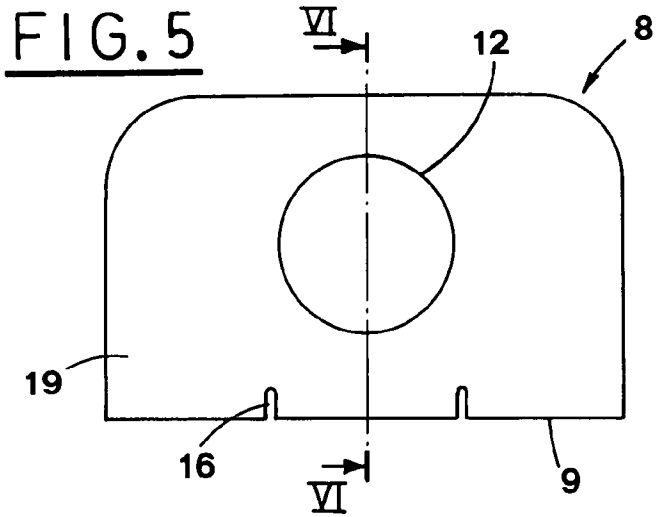
FIG. 5 is a view of the body of FIG. 1 in a subsequent working step.

A lateral through aperture 12, e.g. circular, is made on each of the opposite large sides 4, 5 (FIG. 5).

The aperture 12 can be made by punching or drilling, the choice of the technique depending on the materials used and thickness obtained.

Figure 9:
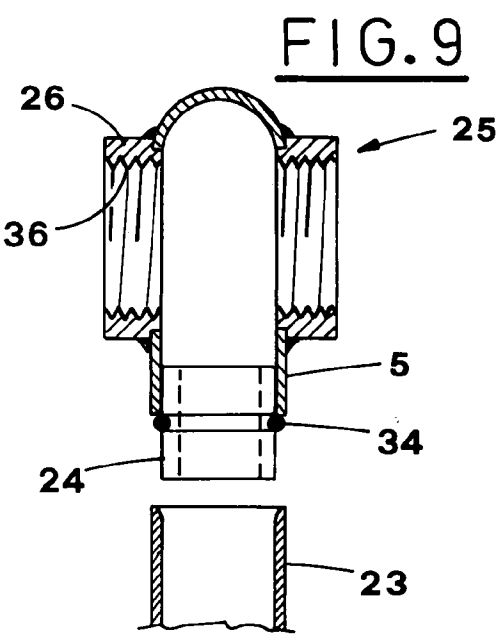
FIG. 9 is a section view of the finished head element.

As shown in FIG. 9, fastening means 25 are made on each lateral through aperture 12 of each of the opposite large sides 4, 5, so as to allow mutual fastening of the adjacent hollow bodies to assemble groups formed by the head elements and the tubular elements, thus building a heater.

According to a first embodiment, shown in FIG. 9, the fastening means 25 on each lateral through aperture 12 are obtained by welding a threaded ring 26 around the lateral through aperture 12.

A threaded joint (not shown) is then screwed into the inner threading 36 of the ring 26 during the heater assembly.

According to another embodiment of the fastening means 25, shown in Figures from 11 to 15, a circular crown 27, extending around each lateral through aperture 12, is obtained by applying a pressure directed outwards, thus deforming plastically the hollow body 8 and forming a protruding edge 31.

The protruding edge 31 is obtained by introducing a flat core 28 into the hollow body 8 through the open side 6, before the holes 13 are made (FIG. 11).

The flat core 28 is equipped with a floating element 29, which is situated in a position matching each lateral through aperture 12 and is pushed outwards alternately in opposite directions, thus forming the protruding edge 31 on the circular crown 27.

A die 30 is situated on the outer part of the hollow body 8 during the pressing on the circular crown 27, to strike as a stop against the hollow body 8 and form the protruding edge 31 from outside (FIGS. 12 and 13).

The protruding edge can be obtained by using a mechanical press or a fluid-pressing device (hydro-forming).

At this point the apertures 12 can be finished, e.g. by boring or other suitable known technique.

A threaded ring 38 can be inserted into the seat defined by the protruding edge 31.

The ring 38 fulfills the same function as the ring 26, fastened externally in the previously described embodiment, as shown in FIG. 14.

Otherwise, the adjacent head elements can be joined by welding spots 37 of the circular crowns touching each other, as shown in FIG. 15, using the apertures 12 arranged in a sequence, to enter this area.

Independently from the used embodiment of the fastening means 25, two notches 16, suitably spaced apart, are made on each of said opposite large sides 4, 5, along said edge 9, so as to leave three areas 19 of the edge 9 unvaried and without the notches.

The depth of the notches must be determined by the dimensions of the head elements to be obtained and of the holes to be obtained for coupling with the tubular elements 23.

In the example case, there are three holes for tubular elements.

However, the method can be advantageously carried out also with a smaller number of holes, e.g. two, or a bigger number of holes, e.g. four holes.

The number of the notches 16 to be made on each opposite surface 4, 5 depends substantially on the number of the holes and is smaller to it by one.

Therefore, with two holes to be obtained, it is necessary to make only one notch 16 on each surface, while with three holes to be obtained, two notches 16 must be made on each surface.

Figure 7:
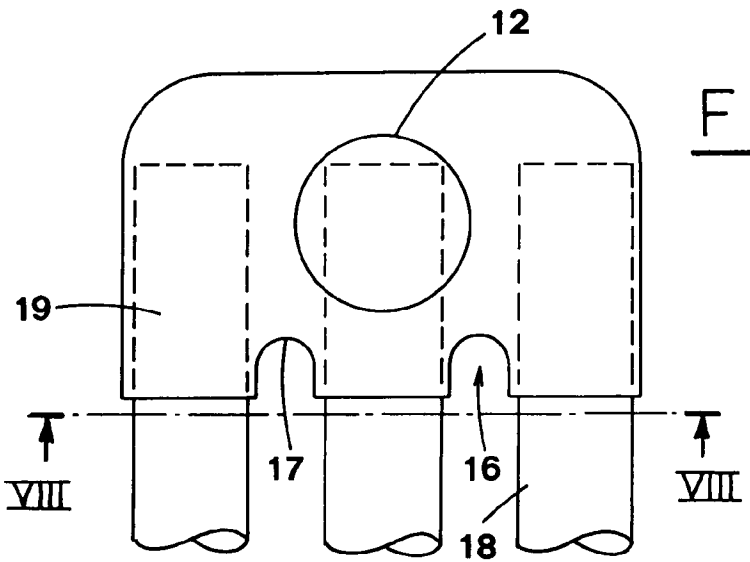
FIG. 7 is a view of the body of FIG. 5 in another working step of the present method.

Cylindrical cores 18 are introduced into the edge 9, in the region of to the intact areas 19 (FIG. 7).

The number of cylindrical cores 18 corresponds to the number of the holes 13 to be made.

In the shown example, three cylindrical cores 18 have been introduced.

The depth of introduction of the cylindrical cores 18 into the hollow body 8 depends substantially on the depth of the notches, and is at least identical thereto.

A flange 17, extending around each notch 16 and situated between the two cylindrical cores 18, is pressed to close the sheet metal around the cores in the area of the edge 9, and at the same time the notches 16 are widened.

Figure 8:
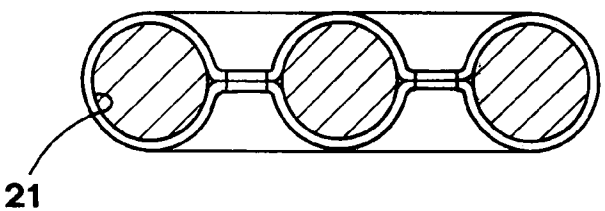
FIG. 8 is the body of FIG. 7 along the line VIII—VIII.
Figure 6:
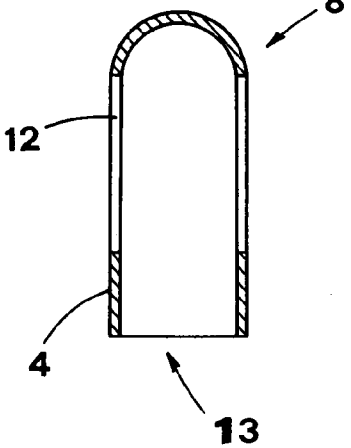
FIG. 6 is a section view of the body along the line VI—VI of FIG. 5.

Therefore, the sheet metal in the area of the notches is pushed against the cores 18 and deformed plastically, thus assuming the curved shape of the cores, as well seen in FIG. 8.

Afterwards, the cores 18 are withdrawn and the edge 9 is welded along the flange 17 of the widened notches 16, so as to obtain three holes 21 separated from each other.

Possible finishing operations, moreover not necessary, will be performed only on the flanges 17, slightly protruding due to the material brought by the welding.

At this point, it is possible to postpone the application of the fastening means 25 to the surfaces 3, 4 of the hollow body 8, only if the fastening means are formed by the outer threaded ring 26, and consequently it is possible to treat a piece which is lighter and structurally less rigid.

The holes 13 are coupled with the tubular elements 23 by a small cylinder 24, introduced into each hole 13 and featuring a groove along its circumference, into which a ring 34 of fusible material is inserted.

Then, the head of each tubular element 23 to be coupled is fitted onto the part of the small cylinder 24 protruding from the relative hole 13.

The connection area between the tubular elements 23 and the head element at the corresponding holes 13 and the ring 34 of the fusible material, is heated by a flame carried rotating around the connection area.

The heat causes the fusion of the ring 34, thus welding the head element to the tubular elements 23 by brazing.

The above described method allows the production of a head element for heaters comprising only one hollow body 8 composed of a base wall 3, two opposite large sides 4, 5, joined to the base wall 3, two narrow sides 14, 15, joined to the base wall 3 and integral with the two opposite large sides 4, 5 and of holes 13, e.g. three, turned toward the inside of the hollow body 8.

A lateral through aperture 12, equipped with fastening means 25, is made on each of the opposite large sides 4, 5.

The hollow body 8 is obtained from one piece of sheet metal by deep-drawing.

The holes 13 are delimited by an edge 9, shaped by cold stamping, which defines an open side 6, opposite to the base wall 3 of the hollow body 8, with notches 16 made on the edge 9 and widened by cold stamping, so as to define the pressed flanges 17, which surround the notches 16 and are welded to each other to separate the holes 13.

In the shown example, there are three holes 13, which need two notches 16.

The fastening means 25 on each lateral through aperture 12 can be made according to two embodiments.

According to a first embodiment, the fastening means 25 include a threaded ring fastened to the relative surface 4, 5.

According to the second embodiment, the fastening means 25 on each lateral through aperture 12 are obtained by a circular crown 27 surrounding the lateral through aperture 12, which has been plastically deformed by pressing outwards, so as to form a protruding edge 31.

A threaded ring 38 is introduced into the seat defined by the protruding edge 31 and fixed therein either by welding spot or by slight deformations made in the material of the head. Any other means can be used to fix the threaded ring and avoid rotation thereof.

Otherwise, the circular crown 27 is left free to be fastened to an adjacent head element by welding.

Consequently, the objects listed in the introduction have been obtained by the method for producing head elements and the head element described above.

The head element is produced in a single body, by more pressing steps, without the drawbacks resulting from the fusion procedure and without the necessity to weld two semi-shells to each other, or other elements of considerable dimensions for the head element closing.

This feature allows to reduce the production time and costs and to obtain a product of high quality, yet using ferrous material, which is cheap and easy to work.

The head element obtained by the above mentioned method is aesthetically pleasant, which allows to reduce as much as possible other finishing operations.

The invention claimed is:

1. Method for producing head elements for heaters comprising the steps of:

preparing a piece of a sheet metal (1);

deep drawing said sheet metal piece (1) to obtain a hollow molded piece (2), defined by a base wall (3), sides (4,5,14,15) joined to and surrounding the base wall and forming an open side (6);

cutting the sides (4,5,14,15) along the open side (6), to define a hollow body (8) with an edge (9), which is uniform and extends around said open side (6);

making a lateral through aperture (12) on two opposite sides (4,5) of the hollow molded piece to obtain apertured opposite sides;

providing fastening means (25) around each lateral through aperture (12) made on the hollow molded piece;

making at least one notch (16), on the apertured opposite sides (4,5), along said edge (9);

introducing at least two cylindrical cores (18) into said edge (9) of said apertured hollow molded piece in matching areas (19) without said at least one notch (16);

stamping a flange (17) for extending around each of said at least one notch and between said cores (18), so as to close the sheet metal around said cores (18) and in the area of said edge (9), thus widening said notches (16) and forming circular holes around the cylindrical cores;

removing said cores (18) from the hollow body;

welding said edge (9) along said flange (17) of said widened at least one notch (16), so as to obtain a series of holes (21) separated from each other; the fastening means (25) provided on each lateral through aperture (12) by pressing outwards a circular crown (27), extending around each lateral through aperture (12), so as to form a protruding edge (31) on each of said apertured sides (4,5).

2. Method, according to claim 1, characterized in that the fastening means (25) are obtained on each lateral through aperture (12) by welding a threaded ring (26) around the lateral through aperture (12).

3. Method, according to claim 1, characterized in that a threaded ring (38) is placed inside the seat defined by said protruding edge (31).

4. Method for producing head elements for heaters comprising the steps of:

preparing a piece of a sheet metal (1);

deep drawing said sheet metal piece (1) to obtain a hollow molded piece (2), defined by a base wall (3), sides (4,5,14,15) joined to and surrounding the base wall and forming an open side (6);

cutting the sides (4,5,14,15) along the open side (6), to define a hollow body (8) with an edge (9), which is uniform and extends around said open side (6);

making a lateral through aperture (12) on two opposite sides (4,5) to obtain apertured opposite sides;

providing fastening means (25) around each lateral through aperture (12);

making at least one notch (16), on the apertured opposite sides (4,5), along said edge (9);

introducing at least two cores (18) into said edge (9) in matching areas (19) without said at least one notch (16);

stamping a flange (17) extending around each of said at least one notch and between said cores (18), so as to close the sheet metal around said cores (18) and in the area of said edge (9), thus widening said notches (16);

removing said cores (18) from the hollow body;

welding said edge (9) along said flange (17) of said widened at least one notch (16), so as to obtain a series of holes (21) separated from each other, the fastening means (25) being obtained on each lateral through aperture (12) by pressing outwards a circular crown (27), extending around each lateral through aperture (12), so as to form a protruding edge (31) on each of said apertured sides (4,5), said outward pressing being obtained by inserting a flat core (28) into said hollow body (8), through the open side (6), before the holes (13) are made, said flat core (28) being equipped with a floating element (29), which is situated to match each lateral through aperture (12) and being pushed outwards alternately in opposite directions, thus causing the forming of the protruding edge (31) on said circular crown (27), while on the outer part of the hollow body (8) a die (30) is situated, to strike against the hollow body (8) and form the protruding edge 31 from outside.

5. Method, according to claim 1, characterized in that two notches (16), spaced from each other, are made on each of said apertured opposite sides (4,5), along said edge (9), to create three free areas (19), and three cores are introduced into said edge (9) positioned to match said free areas (19).

6. Method, according to claim 1, characterized in that the drawing of said metal sheet (1) in order to obtain said hollow molded piece (2) includes a series of subsequent steps.

7. Method for producing head elements for heaters comprising the steps of:

preparing a piece of a sheet metal (1);

deep drawing said sheet metal piece (1) to obtain a hollow molded piece (2), defined by a base wall (3), sides (4,5,14,15) joined to and surrounding the base wall and forming an open side (6);

cutting the sides (4,5,14,15) along the open side (6), to define a hollow body (8) with an edge (9), which is uniform and extends around said open side (6);

making a lateral through aperture (12) on two opposite sides (4,5) to obtain apertured opposite sides;

providing fastening means (25) around each lateral through aperture (12);

making at least one notch (16), on the apertured opposite sides (4,5), along said edge (9);

introducing at least two cores (18) into said edge (9) matching areas (19) without said at least one notch (16);

stamping a flange (17) extending around each of said at least one notch and included between said cores (18), so as to close the sheet metal around said cores (18) and in the area of said edge (9), thus widening said notches (16);

removing said cores (18) from the hollow body;

welding said edge (9) along said flange (17) of said widened at least one notch (16), so as to obtain a series of holes (21) separated from each other, the coupling of the tubular elements (23) with said head element being obtained according to the following steps:

inserting a small cylinder (24) into each hole (13), said small cylinder (24) having a groove made along its circumference, into which a ring (34) of fusible material is inserted;

fitting the head of each tubular element (23) to be connected on the part of the small cylinder (24) protruding from the relative hole (13);

heating the connection area between each tubular element (23) and the head element near the holes (13) and the ring (34) of fusible material, thus welding the head element and tubular elements (23) by brazing.

8. A method according to claim 1, wherein said apertured sides (4,5) are larger than the other non-apertured sides.

9. A method for producing head elements for heaters, characterized in that it includes:

preparation of a piece of a sheet metal (1);

deep drawing of said sheet metal (1) to obtain a hollow molded piece (2), defined by a base wall (3), sides (4,5,14,15) joined to and surrounding the base wall (3) and delimiting an open side (6);

cutting the sides (4,5, 14,15) near said open side (6), to define a hollow body (8) with an edge (9), which is uniform and extends around said open side (6);

making a lateral through aperture (12) on each two opposite sides (4,5) to obtain two apertured opposite sides;

making at least one notch (16), on each of said apertured opposite sides (4,5), along said edge (9);

introducing at least two cores (18) into said edge (9) in areas (19) without said at least one notch (16);

pressing a flange (17) extending around said notches and included between said cores (18), so as to close the sheet metal around said cores (18) and in the area of said edge (9), thus widening said notches (16);

removing said cores (18) from the hollow body;

welding said edge (9) along said flange (17) of said widened at least one notch (16), so as to obtain holes (21) separated from each other;

providing fastening means (25) on each lateral through aperture (12) on each of said apertured opposite sides (4,5).

10. A method, according to claim 9, characterized in that the fastening means (25) on each lateral through aperture (12) are obtained by welding a threaded ring (26) around the lateral through aperture (12).

11. A method according to claim 9, wherein said apertured sides (4,5) are larger than the other non-apertured sides.

* * * * *